US007188688B1

(12) United States Patent
LeJeune

(10) Patent No.: US 7,188,688 B1
(45) Date of Patent: Mar. 13, 2007

(54) DOWN-HOLE TOOL FILTER AND METHOD FOR PROTECTING SUCH TOOLS FROM FLUID ENTRAINED DEBRIS

(76) Inventor: Robert J. LeJeune, 108 St. Benjamin Dr., Lafayette, LA (US) 70506

( * ) Notice: Subject to any disclaimer, the term of this patent is extended or adjusted under 35 U.S.C. 154(b) by 256 days.

(21) Appl. No.: 10/982,652

(22) Filed: Nov. 5, 2004

(51) Int. Cl.
*E21B 7/18* (2006.01)

(52) U.S. Cl. ..... 175/312; 175/314

(58) Field of Classification Search ..... 175/312, 175/314; 210/248, 445, 470, 498; 52/302.1, 52/302.7; D23/260, 261; D7/667; 4/290, 4/292, 507, 650, 652
See application file for complete search history.

(56) References Cited

U.S. PATENT DOCUMENTS

| | | | | | |
|---|---|---|---|---|---|
| 989,405 | A * | 4/1911 | Payne | 4/290 |
| 1,524,471 | A | 1/1925 | Benckenstein | |
| D107,370 | S * | 12/1937 | Bly | D23/260 |
| 2,624,411 | A * | 1/1953 | Ellis | 175/19 |
| 3,386,585 | A * | 6/1968 | Weyand et al. | 210/445 |
| 3,400,823 | A * | 9/1968 | Cooper | 210/223 |
| 3,831,753 | A * | 8/1974 | Gaylord et al. | 209/399 |
| 4,336,850 | A | 6/1982 | Fielder | |
| 4,378,294 | A | 3/1983 | Wagner et al. | |
| 4,429,755 | A * | 2/1984 | Williamson | 175/431 |
| 4,495,073 | A | 1/1985 | Beimgraben | |
| 4,857,175 | A | 8/1989 | Spinnier | |
| 6,397,408 | B1 * | 6/2002 | Veloskey et al. | 4/504 |
| 6,537,447 | B2 * | 3/2003 | Remon | 210/163 |
| 6,955,700 | B2 * | 10/2005 | Zia et al. | 55/495 |
| 2005/0121233 | A1 * | 6/2005 | Frith | 175/57 |

* cited by examiner

*Primary Examiner*—William Neuder
(74) *Attorney, Agent, or Firm*—Robert N. Montgomery

(57) ABSTRACT

An improved apparatus for filtering down-hole drilling fluids, insertable at any point in the drill string, i.e.: tool joints or within instrument subs. The filter element is a disk insertable between the two threadably connected ends of any two lengths of the drill string or adaptively placed within a tool joint containing down-hole tools such as data gathering instruments. The filter is essentially a disk having a series of expanding concentric radial slots and may be used in combination with an X collar support ring insert, combined with a sleeve having a landing ring or provided with a retrieval means.

15 Claims, 5 Drawing Sheets

DOWN-HOLE TOOL FILTER AND METHOD FOR PROTECTING SUCH TOOLS FROM FLUID ENTRAINED DEBRIS

1. FIELD OF THF INVENTION

This invention relates generally to down-hole filtering devices incorporated into tool joints at any location within a drill string and more particularly to a filter located in tool joints containing down-hole instruments therein subjected to fluid flow through their annulus wherein debris carried by said fluids down-hole tends to damage the instruments.

2. GENERAL BACKGROUND

Drilling fluids are widely used for the drilling of oil and gas wells. These drilling fluids provide suppression of reservoir pressure, lubrication of the drill pipe and effect cooling of the bottom hole drill assemblies. Down-hole assemblies may contain individual components such as bits, stabilizers, measurement while drilling tools, etc. Often the down-hole assemblies contain electronic instruments that contain microprocessors that are used to collect and/or transmit data collected by various sensor arrays.

Drilling fluids generally contain a variety of elements, both desirable and undesirable, such as mud, chemicals, drill cuttings, metal shavings, etc. The particle size of these various elements varies from a few microns to several inches. Additionally, rig crews often inadvertently drop tools, gloves, rags, and other foreign or unwanted materials into the well bore. In addition, broken pump and valve parts are often dropped into the mud reclamation tanks and are carried down stream in the drill string. The unwanted and/or undesirable solids, referred to as debris, can be extremely harmful to down-hole tools containing instruments and the like. Therefore, it is desirable to filter the drilling fluid at the drill floor.

Many methods of filtering well bore fluid have been used. One such method includes placing a filter-like screen in the tubular members while the tubular members are being run into the well bore. The prior art devices presently available utilize a cylindrical or conical screen with an external retrieval neck.

It is quite beneficial to screen the drilling fluid being pumped down-hole through the annulus of the drill string at the drill floor in a manner that is supposed to eliminate any foreign debris from becoming entrained in the fluids that may plug or damage any of the down-hole tools or sensitive instruments located therein during drilling operations.

However, it has been the practice to remove such filter screens at some point to allow for passage of down hole tools though the annulus. Therefore, it has been the accepted practice to install filter screens at critical locations, such as at the entrance to the mud pump, but such filter screens have often proven inadequate and provide no protection from debris that passes though the tubing from the mud reclamation tanks after the above described screen filters have been removed. Although such mud screens have been inserted into the tubular drill string, they have the disadvantage of being cumbersome to install and difficult to remove or to clean if necessary. In many cases, the removal can only be accomplished by tripping the pipe out of the hole which, of course, becomes impossible in the event that the pipe is stuck. If left in place, the down-hole screen will provide a blockage to any tools, such as survey instruments, string shots, etc., that may be run any time during the drilling operation. Of course, the screen may eventually become plugged and severely limit the flow of fluid unless it is removed and cleaned occasionally. Down-hole type screens heretofore provided, although capable of removal, run an extreme risk that the debris collected by the screen will escape from the screen during the removal process and plug the down-hole devices meant to be protected in the first place. Therefore, there is a need for a tool joint filtering device that remains in the well annulus, adjacent a down-hole tool, which efficiently filters the drilling fluid while still allowing maximum flow-through capabilities. It is far better to retrieve a tool that has become inoperative due to a plugged filter than due to extreme damage.

In addition, since the down-hole drilling fluids are quite abrasive and are pumped at high pressures of approximately 5000 PSI, any reductions in orifice size increase velocity. Therefore, filters and strainer disks having such orifices suffer significant wear and breakage. It becomes obvious that in cases where high velocity is not required orifice size should be kept to a maximum and that more attention should be paid to the type of metal, surface preparation, and cladding.

In some cases where high velocity is an advantage, such as that disclosed by Gaylord in U.S. Pat. No. 3,831,753, wherein the strainer is comprised of a pair of stacked disks having a plurality of slots with the disks rotated in a manner whereby the slots are approximately 90 degrees apart. This arrangement provides a plurality of square holes subjected to high-pressure abrasion. In addition the strainer disk is seated within a pipe joint subsection that adds cost to the strainer. The Gaylord apparatus provides an increase in velocity and excessive wear that is undesirable in other locations in the drill string. Such is the case of filtering out damaging debris from entering sensitive instrument tool joints where breakage of the strainer disk could create the problems mentioned herein.

It should be clearly understood that, in most cases, restriction of fluid flow by a filter element should be kept to a minimum while preventing large, potentially damaging debris from entering sensitive areas.

3. SUMMARY OF THF INVENTION

An apparatus for filtering down-hole drilling fluids is disclosed, the apparatus being insertable at any point in the drill string, i.e.: tool joints or within instrument subs. The filter element is a disk insertable between the two threadably connected ends of any two lengths of the drill string or adaptively placed within a tool joint containing down-hole tools such as data gathering instruments. The filter is essentially a disk having a series of expanding concentric radial slots. The filter disk may be used in combination with an X collar support ring insert or combined with a sleeve having a landing ring, or provided with a retrieval means. One embodiment further includes a sleeve having an o-ring attached to the disk for location within the instrument cavity of a sub-joint, adjacent to the sensitive electronic instrument itself. Still another embodiment utilizes the filter ring in conjunction with a landing ring within the float cavity of a bit and check valve subsection. In some cases, it may also be advantageous to remove the filter ring while down-hole. Therefore, provisions for such an embodiment are also described herein.

4. BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein: FIG. 1 is an isometric partial section view of a filter assembly embodiment;

5. DETAILED DESCRIPTION OF THE PREFERRED EMBODIMENT

As discussed above, a filter disk having sufficient orifice area to pass drilling fluids through an annulus, around sensitive down-hole instruments, to fluid motors and drill bit assemblies further down stream. The filter disk is quite beneficial to prevent damage to the equipment and thus reduce down time.

Figure 1:
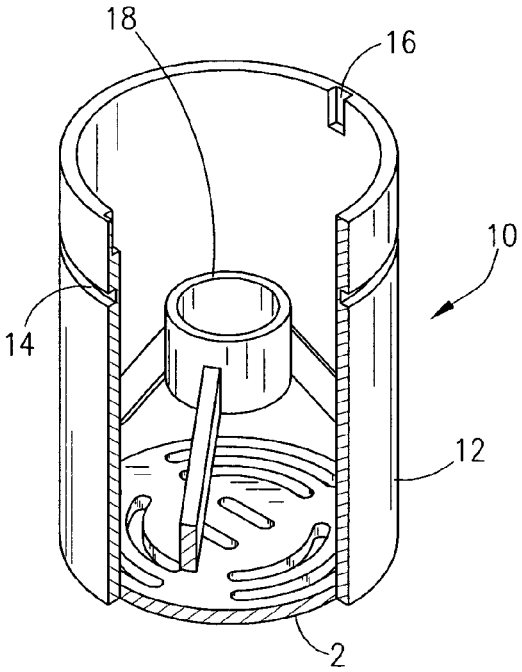
Figure 2:
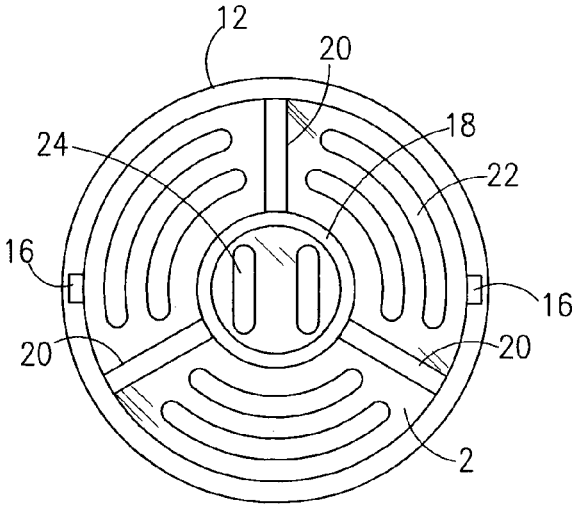
FIG. 2 is a top view of the assembly shown in FIG. 1.

As seen in FIG. 1, the filter disk 2 may be installed within the preferred embodiment of a landing ring sleeve assembly 10. This embodiment includes the filter disk 2, located within one end of a sleeve 12, having an O-ring groove 14 with rotation and removal notches 16 used to place and position the sleeve within an instrument tool sub 26. A landing ring 18 is also provided within the sleeve 12 for landing and centering other instrument packages. As seen in FIG. 2, the landing ring 18 and its support legs 20 do not interfere with the circular orifices 22 or parallel orifices 24

Figure 3:
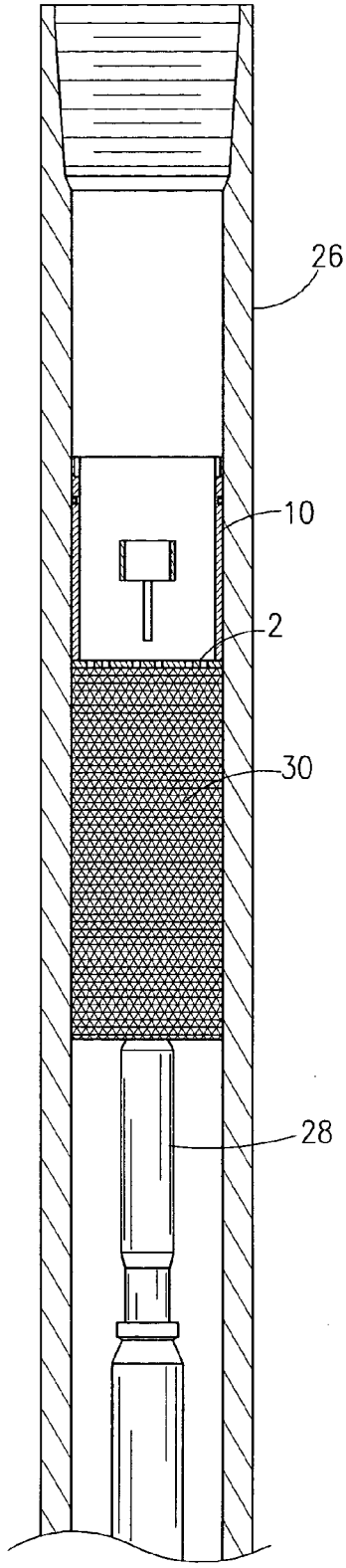
FIG. 3 is a vertical section view of an instrument sub assembly with the assembly of FIG. 1 shown in cross section.

The assembly 10 is located within the instrument sub 26 above the instrument assembly 28 in a cup-like manner, as shown in FIG. 3, thus insuring that any relatively large debris is collected by the filter disk 2 before entering the filter screen 30.

Figure 4:
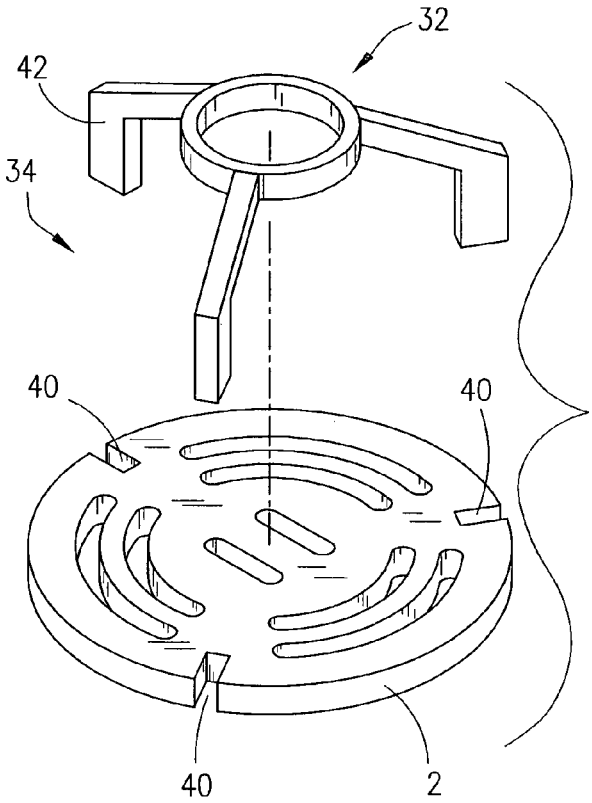
FIG. 4 is an isometric view of a second embodiment of the filter disk and landing ring assembly.
Figure 5:
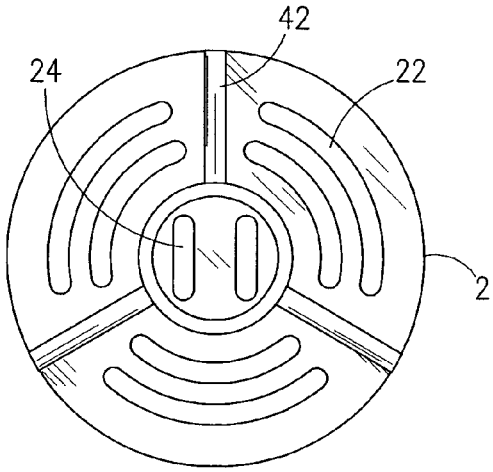
FIG. 5 is a top view of the assembly shown in FIG. 4.
Figure 6:
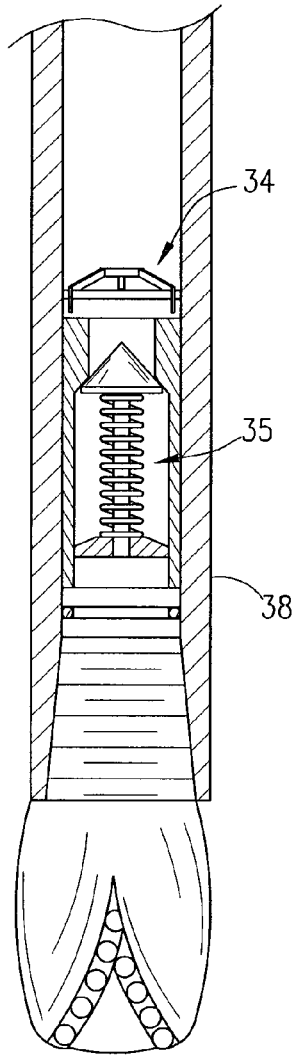
FIG. 6 is a vertical section view of the assembly shown in FIG. 4 in combination with a drill bit check valve arrangement.

Another embodiment, as seen in FIG. 4, uses the filter disk 2 as an intermediate member between the landing ring 32 and hub assembly 34, commonly used adjacent the check valve assembly 36 located within the bit sub 38, as seen in FIG. 6. In this case, notches 40 are provided in the filter disk 2 to accept the legs 42 of the landing ring assembly 32 and thus orient the disk so as to insure that the landing ring 32 does not obstruct the slots 22, 24 as seen in FIG. 5. Necessary obstructions such as landing ring 18,32 need to direct the drilling fluids laden with silica to the orifices without causing high volume high shear eddies that tend to wear away petitions between the orifices 22,24.

Figure 9:
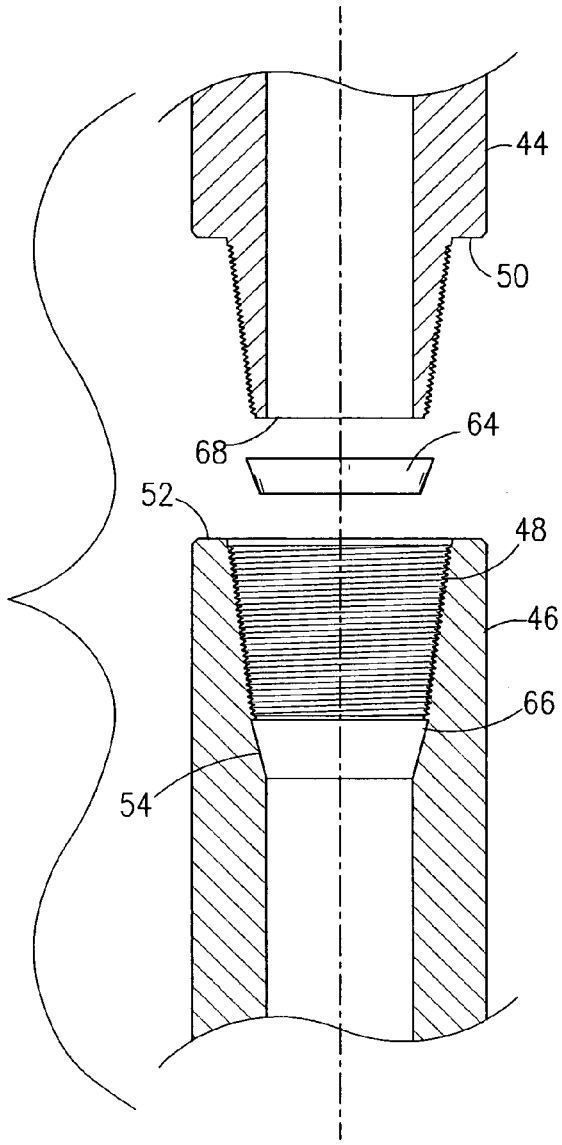
FIG. 9 is an expanded section view of the disk and ring embodiment seen in FIG. 12 relative to the drill string joint members.

It should be understood that drill string tool joints are upsets on the end of pipe joints used to threadably couple sections of pipe and are comprised of an externally threaded pin end 44 and an internally threaded box end 46 seen in FIG. 9. However, similar joint configurations without the upsets are used for coupling drill collars and the like. The pin end 44 is externally taper-threaded and the box end 46 is cooperatively internally threaded to accept the pin end 44.

Figure 7:
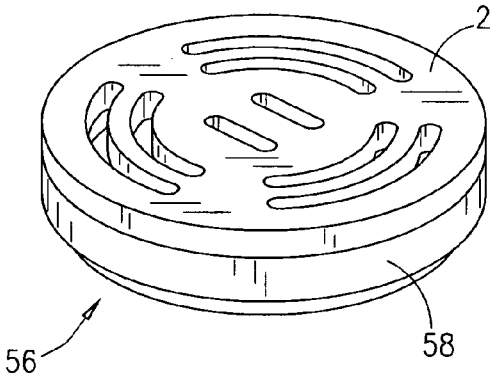
FIG. 7 is an isometric view of the filter disk and bevel ring combination.
Figure 8:
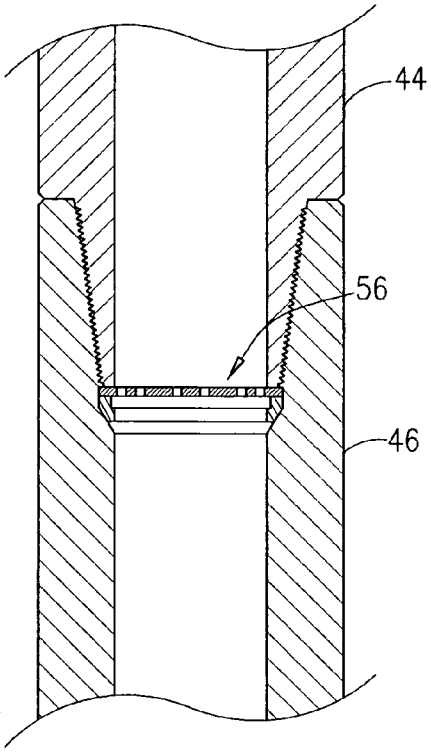
FIG. 8 is a section view of the disk and ring shown in FIG. 7 as placed and captured within the drill string joint assembly.
Figure 11:
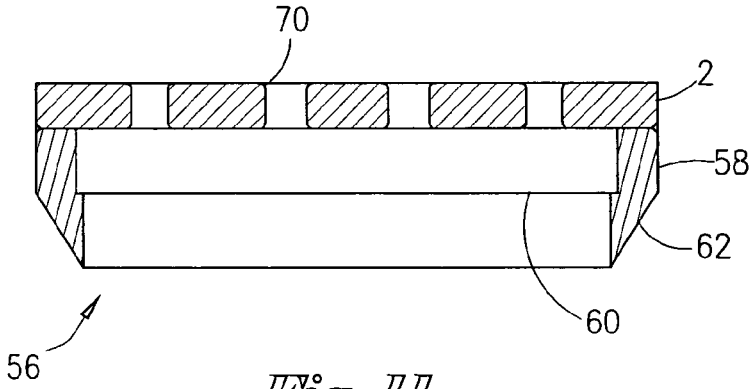
FIG. 11 is a cross-section view of the filter disk and ring assembly shown in FIG. 7.
Figure 12:
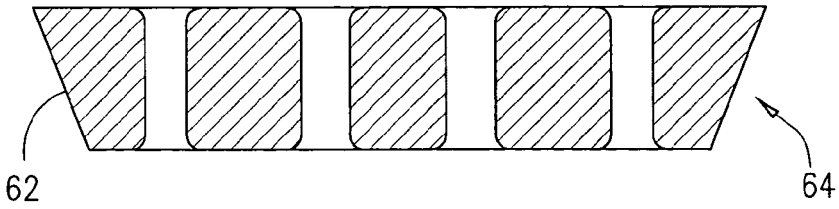
FIG. 12 is a cross-section view of a unitized filter disk.

An internal thread 48 is formed within the box end 46 tool-joint for approximately four to five inches as shown in FIG. 9. A thread relief groove 54, 66 is formed at the base of the internal threads to prevent incomplete thread damage. A shoulder 50 is formed at the base of the threads on the pin end 44, which lands on the rim 52 of the box end 46 when the joint is fully engaged. When the joint is completed, a bottom annularly inclined lip 54 is formed at the base of the threads 48 within the box end 46 between the internal threads 48 and the end of the pin end 44, thus taking advantage of the thread relief groove 54,66. This bottom inclined lip 54 or thread relief space 66 may normally be used in the drilling operation to hold a corrosion ring, not shown in the drawings. This relief space 54,66 may also be used to insert a filter disk assembly 56 that is composed of a filter disk 2 and a corrosion ring 58 or a ring having a similar configuration, such as may be seen in FIG. 7. The filter disk assembly 56 may be placed in any tool joint assembly within the drill string and captured therein by the pin end 44 as shown in FIG. 8. The filter disk 2 may be combined with the corrosion ring 58 or any suitable ring that may be readily available off the shelf, as shown in FIG. 11. Such corrosion rings 58 are common in the industry and are used as adaptors for conical strainers and the like. The corrosion rings 58 may have an internal socket 60 but must have the cooperative external bevel 62 consistent with the relief groove 54, 66. The filter disk 2, 64 may be fixed to the ring 58 or simply rest on top of the ring 58. The filter disk may be configured as single member 64, as shown in FIG. 12, by simply providing the external bevel 62 to match the box end 46 internal lip 54 and installed, as shown in FIG. 9, thus leaving a space 66 between the filter disk assembly 56 and the end 68 of the pin end 44, as seen in FIGS. 8, 9.

It should be understood that the upper and lower edges of each of the orifices 22, 24 have well rounded or radius edges on all sides to prevent excessive wear points. Close attention should be given to the material used for the disk 2, 64 due to it being subjected to high temperatures, corrosion, and high-pressure fluids having entrained highly abrasive materials. The disk 2, 64 is also subjected to high impact due to foreign bodies striking the disk at high velocity and pressure. Therefore, it is essential that the disk 2, 64 materials have excellent impact resistance as well as wear resistance.

The filter disk 2, 64 is made of modified AISI 4140 alloy, oil hardened steel for toughness and ductility, combined with an as-purchased Brinell hardness between 185 and 200 or Rockwell C of 26 to 34. This material provides good machinability and a tensile strength of 95,000 PSI and minimum yield strength of 60,000 PSI. The base substrate is then plasma coated with 0.015 thick tungsten nickel and carbon composition to reduce surface wear. Other materials such as 17–4 PH may be considered for more specific down-hole conditions. However, cost is also a significant consideration.

Figure 10:
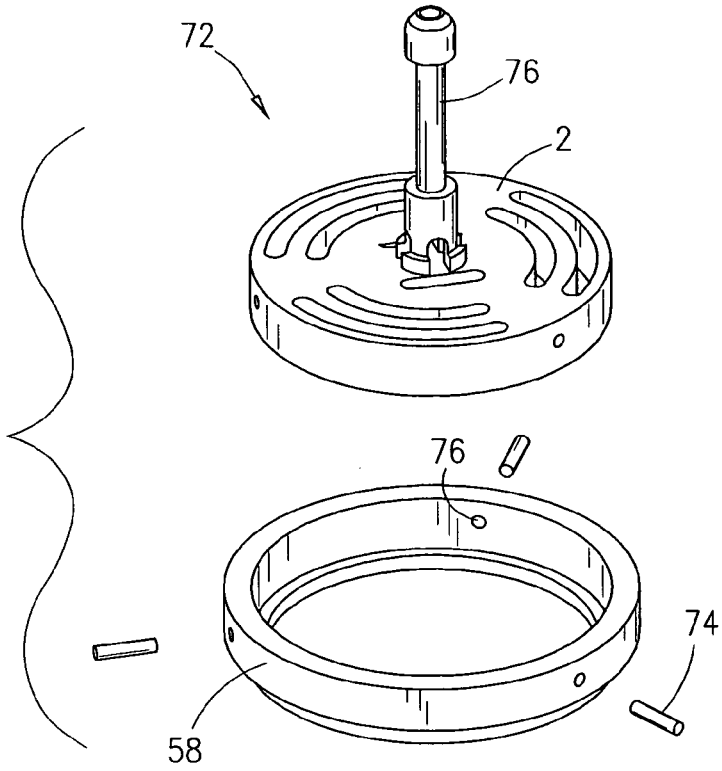
FIG. 10 is an isometric exploded view of a retrieval assembly embodiment of the filter disk.
Figure 13:
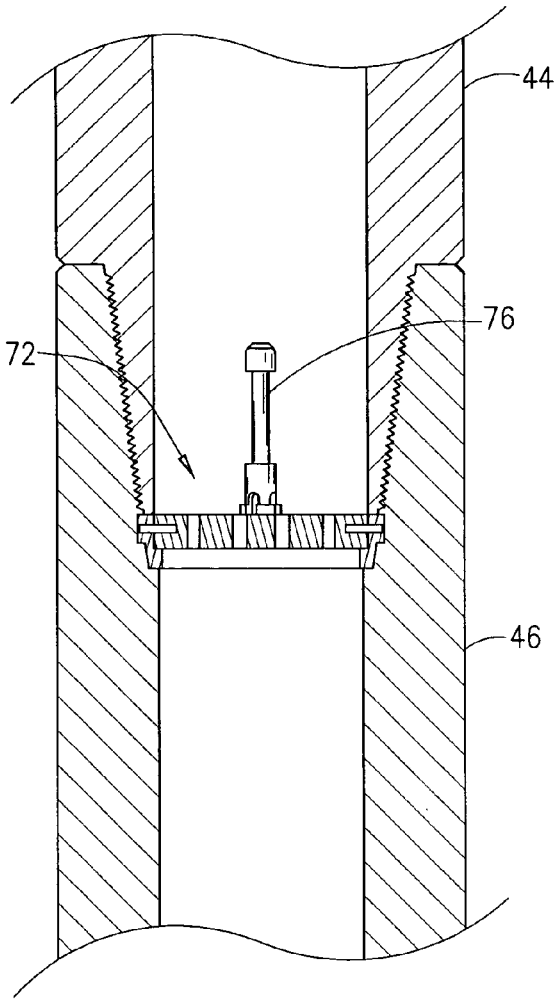
FIG. 13 is a section view of the retrievable filter disk assembly seen in FIG. 10 placed and captured within a drill string joint.
Figure 14:
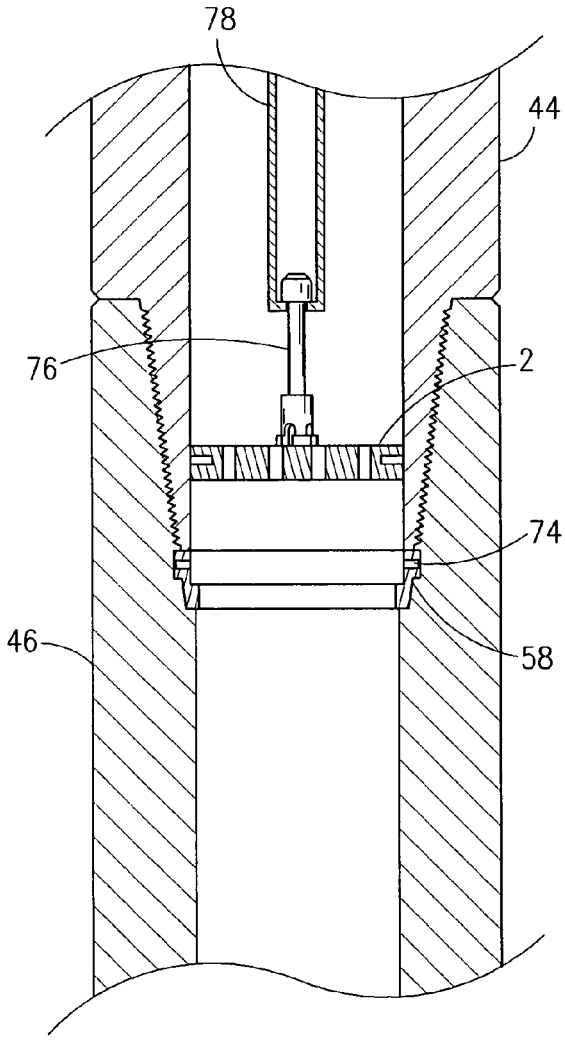
FIG. 14 is a section view of the retrievable filter disk assembly seen in FIG. 10 placed and captured within a drill string joint being retrieved.

In some cases, it may become beneficial to remove the filter disk 2 from a tool joint while down-hole to allow passage of tools and instruments. Therefore, it may be beneficial to provide a filter retrieval disk assembly 72, such as that shown in FIG. 10. The retrieval disk assembly 72 utilizes the internal socket 60 of the corrosion ring 58, seen in FIG. 11. The filter disk 2 is reduced in diameter to fit within the socket 60 of the ring 58 and retained therein by shear pins 74 inserted through holes 76 in the ring 58 and into the disk 2 in the manner illustrated in FIGS. 10, 11. A retrieval pin 76 is also provided, centrally secured to the upper side of the filter disk 2. With the retrieval disk assembly in place, as seen in FIG. 13, a retrieval tool 78 may be used to grasp the retrieval pin 76. Upward movement of the retrieval tool 78 shears the pins 74 and allows the disk 2 to be separated from the ring 58, as shown in FIG. 14.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

The invention claimed is:

1. A down-hole tool joint filter assembly comprising tubular sleeve having a disk member attached internally at one end having a plurality of radial slots arranged in expanding concentric circles with said slots in alignment and a pair of parallel slots central to said radial slots said sleeve having a plurality of internal notches located at an end opposite the disk member.

2. The down-hole tool joint filter assembly according to claim 1 wherein said tubular sleeve further comprises a centralized landing ring supported by a plurality of legs internally attached to said sleeve above the disk member.

3. The down-hole tool joint filter assembly according to claim 2 wherein said sleeve further comprises an external o-ring groove.

4. The down-hole tool joint filter according to claim 1 wherein said filter disk is comprised of a alloy steel having a modified chemistry of at least AISI 4140 and heat treated to a minimum of 26 to 34 Rockwell C.

5. The down-hole tool joint filter according to claim 4 wherein said filter disk is plasma coated with tungsten having an average thickness of 0.015.

6. A down-hole tool joint filter assembly comprising a disk member having a plurality of radial slots arranged in expanding concentric circles with said slots in alignment a pair of parallel slots central to said radial slots and a plurality of peripheral notches the assembly further comprising a centralized landing ring having a plurality of support legs cooperative with and insertable within said peripheral notches.

7. The down-hole tool joint filter according to claim 6 wherein said assembly is inserted within a check valve assembly located within a tubular drill string adjacent a drill bit.

8. A down-hole tool joint filter assembly comprising a disk member having a plurality of radial slots arranged in expanding concentric circles with said slots in alignment a pair of parallel slots central to said radial slots and a ring member attached peripherally thereto said ring having equivalent to a beveled portion consistent with a thread relief groove commonly located within internally threaded tubular tool joints.

9. The down-hole tool joint filter according to claim 8 wherein said disk member resides within said ring member.

10. The down-hole tool joint filter according to claim 9 wherein said disk member is retained within said ring member by shears pins.

11. The down-hole tool joint filter according to claim 10 wherein said disk member comprises a means for connecting a fishing tool for extracting said disk member.

12. A method for intercepting damaging debris entrained within the drilling fluid stream down-hole in oil and gas drilling operations comprising the steps of installing a tool-joint filter disk comprising a plurality of radial slots arranged in expanding concentric circles with said slots in alignment and a pair of parallel slots central to said radial slots within the confines of a thread relief groove commonly located within internally threaded tubular tool joints.

13. The method according to claim 12 further comprising the step of capturing said tool-joint filter disk-within the confines of a thread relief groove commonly located within said internally threaded tubular tool joints by threadably coupling an externally threaded tool joint to said internal threaded tubular tool joint.

14. The method according to claim 12 wherein said tool joint filter disk is retrievable from a tool joint while located down hole.

15. A method for intercepting damaging debris entrained within a drilling fluid stream down-hole in oil and gas drilling operations comprising the steps of:

a) fabricating a tool-joint filter disk assembly comprising a disk member having a plurality of radial slots arranged in expanding concentric circles with said slots in alignment and a pair of parallel slots central to said radial slots attached within a tubular sleeve having a centralized tubular landing ring supported by a plurality of legs attached internally to said sleeve; and b) locating said filter disk assembly upstream and adjacent to a tubular sub-joint containing an electronic instrument.

* * * * *